US008113358B2

(12) United States Patent
Smith

(10) Patent No.: US 8,113,358 B2
(45) Date of Patent: Feb. 14, 2012

(54) PRE-TENSIONED SIFTER SCREEN

(75) Inventor: Joseph L. Smith, Cincinnati, OH (US)

(73) Assignee: M-I LLC, Houston, TX (US)

( * ) Notice: Subject to any disclaimer, the term of this patent is extended or adjusted under 35 U.S.C. 154(b) by 4 days.

(21) Appl. No.: 12/060,386

(22) Filed: Apr. 1, 2008

(65) Prior Publication Data

US 2008/0245707 A1 Oct. 9, 2008

Related U.S. Application Data

(60) Provisional application No. 60/910,048, filed on Apr. 4, 2007.

(51) Int. Cl.
*B07B 1/49* (2006.01)

(52) U.S. Cl. ..... 209/412; 209/399; 209/403; 209/405; 209/409

(58) Field of Classification Search ..... 209/405, 209/409, 412, 399, 403
See application file for complete search history.

(56) References Cited

U.S. PATENT DOCUMENTS

| | | | | |
|---|---|---|---|---|
| 6,202,857 | B1 | 3/2001 | Keller et al. | |
| 6,269,954 | B1 * | 8/2001 | Baltzer | 209/405 |
| 6,439,392 | B1 * | 8/2002 | Baltzer | 209/405 |
| 7,000,776 | B2 * | 2/2006 | Winkler et al. | 209/399 |
| 7,063,214 | B2 * | 6/2006 | Schulte et al. | 209/405 |
| 2004/0149632 | A1 * | 8/2004 | Schulte et al. | 209/405 |
| 2005/0199532 | A1 * | 9/2005 | Schulte et al. | 209/405 |
| 2006/0219608 | A1 | 10/2006 | Scott et al. | |
| 2008/0245707 | A1 * | 10/2008 | Smith | 209/412 |

FOREIGN PATENT DOCUMENTS

| | | |
|---|---|---|
| JP | 05097901 | 4/1993 |
| JP | 08126868 | 5/1996 |
| JP | 2000-246178 | 9/2000 |
| WO | 2005107964 | 11/2005 |
| WO | 2007/067300 A2 | 6/2007 |

OTHER PUBLICATIONS

PCT International Search Report issued in PCT Application No. PCT/US2008/059144 dated Aug. 20, 2008 (3 pages).
PCT Written Opinion issued in PCT Application No. PCT/US2008/059144 dated Aug. 20, 2008 (4 pages).
English Patent Abstract of WO2005107964 from esp@cetnet, published Nov. 17, 2005 (1 page).
English Patent Abstract of JP8126868 from esp@cenet, published May 21, 1996 (1 page).
English Patent Abstract of JP5097901 from esp@cenet, published Apr. 20, 1993 (1 page).
English Patent Abstract of JP2000-246178 from Industrial Property Digital Library, published Sep. 12, 2000 (2 pages).
Official Action issued in corresponding Canadian Patent Application No. 2,682,601; Dated Nov. 18, 2010 (3 pages).

* cited by examiner

*Primary Examiner* — Terrell Matthews
(74) *Attorney, Agent, or Firm* — Osha Liang LLP

(57) ABSTRACT

A screen for a gyratory sifter including a frame having a plurality of cross-members and a rigid external extension. Additionally, the screen including a filtering element securably attached to the frame. Also, a method for installing a pre-tensioned screen in a gyratory sifter including inserting the pre-tensioned screen into the gyratory sifter. The pre-tensioned screen including a frame having a plurality of cross-members and a rigid external extension and a filtering element securably attached to the frame. Additionally, the method including mating the pre-tensioned screen to a ball box, wherein the mating includes placing the pre-tensioned screen against a contoured section of the ball box, and securing the pre-tensioned screen with a screen plate.

5 Claims, 6 Drawing Sheets

PRE-TENSIONED SIFTER SCREEN

CROSS-REFERENCE TO RELATED APPLICATIONS

This application, pursuant to 35 U.S.C. §119(e), claims priority to U.S. Provisional Application Ser. No. 60/910,048, filed Apr. 4, 2007. That application is incorporated by reference in its entirety.

BACKGROUND

1. Field of the Disclosure

Embodiments disclosed herein relate to shaker screens for vibratory sifters. More specifically, embodiments disclosed herein relate to shaker screens for vibratory sifters that are pre-tensioned. More specifically still, embodiments disclosed herein relate to apparatuses and methods for using gyratory sifters including pre-tensioned shaker screens including rigid external extensions.

2. Background Art

Generally, sifters include a class of vibratory devices used to separate sized particles, as well as to separate solids from liquids. Sifters are used to screen, for example, feed material, plastic resins, and powders during industrial sorting and/or manufacturing operations.

Because sifters may be in continuous use, repair operations, and associated downtimes need to be minimized as much as possible. Often, the filter screens of sifters, through which sized materials or liquids are separated, wear out over time and subsequently require replacement. Therefore, sifter filter screens are typically constructed to be removed and replaced. While there are numerous styles and sizes of filter screens, they generally follow similar design.

Typically, filter screens include a perforated plate base upon which a wire mesh, or other perforated filter overlay, is positioned. The perforated plate base generally provides structural support and allows the passage of fluids or sized material therethrough, while the wire mesh overlay defines the largest solid particle capable of passing therethrough. While many perforated plate bases are flat or slightly arched, it should be understood that perforated plate bases having a plurality of corrugated or pyramid-shaped channels extending thereacross may be used instead. The pyramid-shaped channels may provide additional surface area for the sized solids or fluid-solid separation process to take place while acting to guide solids along their length toward the end of the sifter from where they are disposed.

A typical sifter filter screen includes a plurality of hold-down apertures at opposite ends of the filter screen. These apertures, preferably located at the ends of the filter screen that abut walls of the sifter, allow hold down retainers of the sifter to grip and secure the filter screens in place. However, because of their proximity to the working surface of the filter screen, the hold-down apertures must be covered to prevent solids in the material passing therethrough from bypassing the filter mesh through the hold-down apertures. To prevent such bypass, an end cap assembly is placed over each end of the filter screen to cover the hold-down apertures.

In alternate sifters, a filter mesh may be stretched over a frame that is an integral part of the sifter body. Thus, such filter meshes may become tensioned as they are disposed within the sifter. Such methods of attaching filter mesh may involve time consuming filter mesh changing operations, as the old filter mesh must be removed, and a new filter mesh must be tensioned within the sifter body. Removing and then reattaching a filter mesh may involve substantial manual labor, and require significant sifter downtime.

In certain sifter screens, the screen includes a frame with a filter screen attached to the top of the screen. The screen is generally a flat screen with a plurality of location tabs that extend from the base of the frame that help guide the frame into position within the sifter. The lateral extension of the location tabs then press against the body of the sifter, thereby creating a desired tension across the surface of the screen. However, such screens are prone to design failure, because the tensioning of the frame may cause bowing and otherwise cause breaks to form in the body of the frame. Furthermore, the location tabs often wear out over time, decreasing the tension on the frame, and decreasing the sealing efficiency of the screen to the sifter. As sealing efficiency decreases, sized particles may slip though spaces along the screen edge, leading to product loss, further stress points along the screen that may lead to premature screen failure, and otherwise result in the requirement to change the filter mesh more frequently.

Typically, screens used with sifters are placed in a generally horizontal fashion on a substantially horizontal bed or support structure located within a basket in the sifter. The screens themselves may be flat, nearly flat, corrugated, depressed, and/or contain raised surfaces. The basket in which the screens are mounted may be inclined towards a discharge end of the sifter. The sifter imparts a rapidly reciprocating motion to the basket and the screens. A source material, from which particles are to be separated, is poured onto a back end of the vibrating screen. The material generally flows toward the discharge end of the basket. Large particles that are unable to pass through the screen remain on top of the screen, and move toward the discharge end of the basket where they are collected. Smaller particles and/or fluid pass through the screen and collect in a bed, receptacle, or pan therebeneath.

In some sifters, a fine screen cloth is used with the vibrating screen. The screen may have two or more overlying layers of screen cloth or mesh. Layers of cloth or mesh may be bonded together and placed over a support, multiple supports, a perforated plate, or an apertured plate. The frame of the vibrating screen is resiliently suspended or mounted upon a support, and is caused to vibrate by a vibrating mechanism (e.g., an unbalanced weight on a rotating shaft connected to the frame). Each screen may be vibrated to create a flow of trapped solids on top surfaces of the screen for removal and disposal thereof. The fineness or coarseness of the mesh of a screen may vary depending upon the operational requirements of a specified sifting operation.

Replacing un-tensioned screens and filter mesh used in sifters generally is a time consuming and inefficient process that involves removing a number of either attachment mechanisms used to hold down and tension screens, or replacing and tensioning filter mesh to an integral screen, as described above. These screen replacement operations may involve significant downtime of the sifter, which may slow the manufacturing operation. Additionally, present pre-tensioned screens are prone to structural failure do to frame breakage and loss of filter mesh tension over time.

Accordingly, there exists a continuing need for a pre-tensioned sifter screen that may resist structural failure and may provide for more efficient screen changes.

SUMMARY OF THE DISCLOSURE

In one aspect, embodiments disclosed herein relate to a screen for a gyratory sifter including a frame having a plurality of cross-members and a rigid external extension. Additionally, the screen includes a filtering element securably attached to the frame.

In another aspect, embodiments disclosed herein relate to a method for installing a pre-tensioned screen in a gyratory sifter including inserting the pre-tensioned screen into the gyratory sifter. The pre-tensioned screen including a frame having a plurality of cross-members and a rigid external extension and a filtering element securably attached to the frame. Additionally, the method including mating the pre-tensioned screen to a ball box, wherein the mating includes placing the pre-tensioned screen against a contoured section of the ball box, and securing the pre-tensioned screen with a screen plate.

In another aspect, embodiments disclosed herein relate to a method of manufacturing a pre-tensioned screen for a gyratory sifter including forming a frame, wherein the frame includes a plurality of cross-members and a rigid external extension. The method further including securing a filtering element to the frame.

Other aspects and advantages of the disclosure will be apparent from the following description and the appended claims.

DETAILED DESCRIPTION

Generally, embodiments disclosed herein relate to shaker screens for vibratory sifters. More specifically, embodiments disclosed herein relate to shaker screens for vibratory sifters that are pre-tensioned. More specifically still embodiments disclosed herein relate to apparatuses and methods for using gyratory sifters that include pre-tensioned shaker screens having rigid external extensions.

Figure 1:
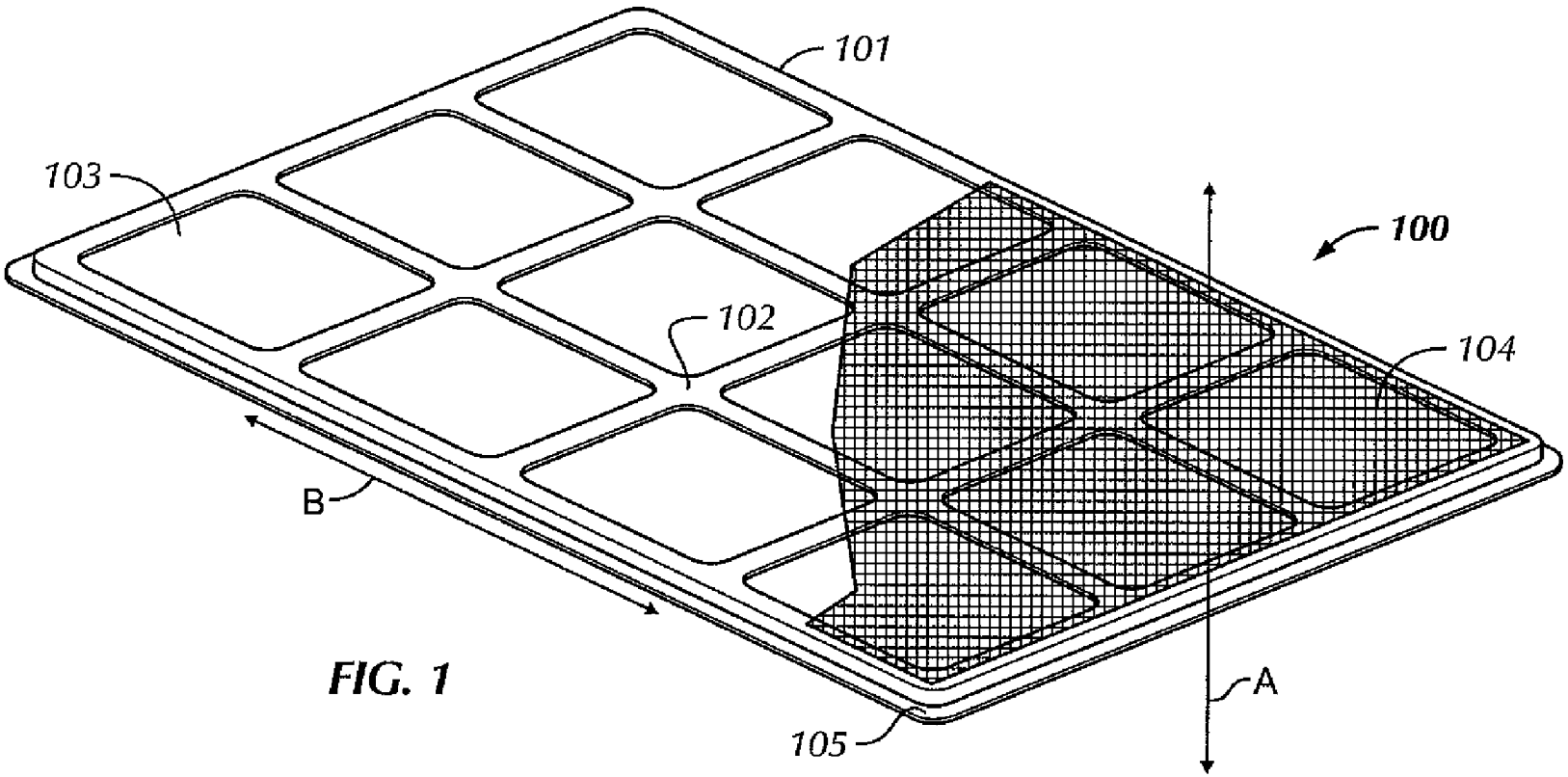
FIG. 1 shows a perspective view of a gyratory sifter screen according to embodiments of the present disclosure.

Referring initially to FIG. 1, a perspective view of a gyratory sifter screen 100 according to embodiments of the present disclosure is shown. In this embodiment, sifter screen 100 includes a frame 101 having a plurality of cross-members 102 forming a plurality of relief areas 103, thereby allowing the passage of materials therethrough. Additionally, screen 100 includes a filtering element 104 disposed on frame 101 including cross-members 102. As illustrated, frame 101 also includes a rigid external extension 105 extruding from a basal section.

In embodiments of the present disclosure, frame 101 and cross-members 102 may be manufactured from, for example, carbon fiber, carbon steel, stainless steel, or other materials as known to those of ordinary skill in the art. For example, in certain embodiments, frame 101 and cross-members 102 may be formed from a single steel piece formed via pressing, bending, or stamping (i.e., a method to make the relief areas) to an appropriate geometry. However, in alternate embodiments, frame 101 and cross-members 102 may be formed from a composite mixture of metal support members surrounded by a glass/resin matrix. Those of ordinary skill in the art will appreciate that the specific manufacturing process of frame 101 and cross-members 102 is not a limitation of the present disclosure.

Filtering element 104 may be manufactured from steel alloys including, for example, 301 grade stainless steel. Filtering element 104 may also be made of, for example, plastics, metals, alloys, fiberglass, composites, and polytetrafluoroethylene (PTFE). In certain embodiments, the filtering element 104 may have two or more layers of the same or different filtering mesh and may be layered in any combination. Additional materials that may be used as a filtering element 104 include porous cloth, composites, and other materials known to those of skill in the art. Generally, the material of filtering element 104 will be determined based on the requirements of a specific sifting operation. For example, in an operation requiring the sifting of a relatively large material from a relatively small material, the optimal filtering element geometry may one that will only allow the relatively small material to pass therethrough. However, in certain operations, the relative size difference in filtered material may be small. In such embodiments, filtering element 104 may include a plurality of filtering layers to achieve an optimized sifting.

Filtering element 104 may be securably attached to frame 101 via, for example, glues, powder epoxy, or through chemical means. However, in alternate embodiments, filtering element 104 may be secured to frame 101 via mechanical fasteners, thermal staking, thermal bonding, or other means known to those of ordinary skill in the art. Furthermore, the securing of filtering element 104 to frame 101 may be determined, at least in part, by pre-tensioning requirements. For example, in a filtering element 104 requiring high tension, the securing means must be capable of withstanding such tensions. Thus, those of ordinary skill in the art will appreciate that the specific attachment means of filtering element 104 to frame 101 will be operationally dependent.

Relief areas 103 include the partitioned sections between, for example, cross-members 102 and other cross-members 102, as well as the partitioned sections between cross-members 102 and frame 101. Relief areas 103 provide an opening that allows the passage of material through filtering element 104 and through screen 100 in general. The specific geometry of relief areas 103 is not a limitation on the present disclosure. However, those of ordinary skill in the art will appreciate that providing the maximum area of relief 103 may increase the flow of materials therethrough. As such, in certain embodiments, it may be beneficial to have a lower number of cross-members 102, thereby increasing the relative area of screening space. However, in certain embodiments, it may be necessary to decrease the area of screening space in lieu of increased rigidity of screen 100. Examples of such embodiments that may require decreased relief area 103 include screens 100 that have high levels of pre-tension. Because the stress on frame 101 in high tension screens 100 may be relatively increased, the structure of frame 101 may require additional support. As such, increasing the size or number, and/or decreasing the malleability of cross-members 102 may further increase the rigidity of screen 100.

As the rigidity of screen 100 increases, the tension of filtering element 104 stretched thereon may also be increased. Those of ordinary skill in the art will appreciate that the area of relief areas 103, the spacing of cross-members 102, and the thickness of, for example, frame 101 and cross-members 102 may be varied to provide an acceptably rigid structure to support the requirements of tensioning a particular screen 100. As such, those of ordinary skill in the art will appreciate that increasing the rigidity of frame 101 and cross-member 102 may further increase the tensioning abilities of filtering element 104 of screen 100.

Screen 100 also includes a rigid external extension 105. Rigid external extension 105 may include an extruded section of frame 101 that extends laterally therefrom. Rigid External extension 105 may further include material properties coincident with frame 101. However, in certain embodiments, rigid external extension 105 may include different material properties, or be manufactured from a different material altogether. The specific geometry of rigid external extension 105 is not a limitation of the present disclosure; however, those of ordinary skill in the art will appreciate that in one embodiment, rigid extension 105 may include an extruded portion of frame 101. Functionally, rigid external extension 105 must be resistant to malleability due to operational forces. Said another way, rigid external extension 105 may specifically resist movement in plane A to prevent the bending of frame 101. Thus, the rigidity of frame 101 is reinforced by rigid external extension 105.

In one embodiment, rigid external extension 105 may generally include an extension around the entire periphery of frame 101. Because the extension extends around the entire periphery, the structural integrity, and thus the frames resistance to bowing from pre-tensioning, may increase. Those of ordinary skill in the art will appreciate that the size of rigid external extension 105 may vary according to the tensioning requirements of a specific screen 100, however, in certain embodiments, the length of extension may be several centimeters. Likewise, the width of rigid external extension 105 may also vary according to specific screen 100 requirements, but generally, the wider the extension, the greater the screens resistance to bowing. As such, for higher pre-tensioning, those of ordinary skill in the art will appreciate that the geometry of rigid external extension 105 may be adjusted accordingly.

Furthermore, those of ordinary skill in the art will appreciate that pre-tensioning of filtering element 104 necessarily biases the bending of frame 101 toward point B. However, embodiments of the present disclosure neutralize the biasing force of pre-tensioning screen 100. Thus, the bending of frame 101 may be decreased and wear on screen 100 may be reduced, thereby preserving the integrity of screen 100.

Figure 2A:
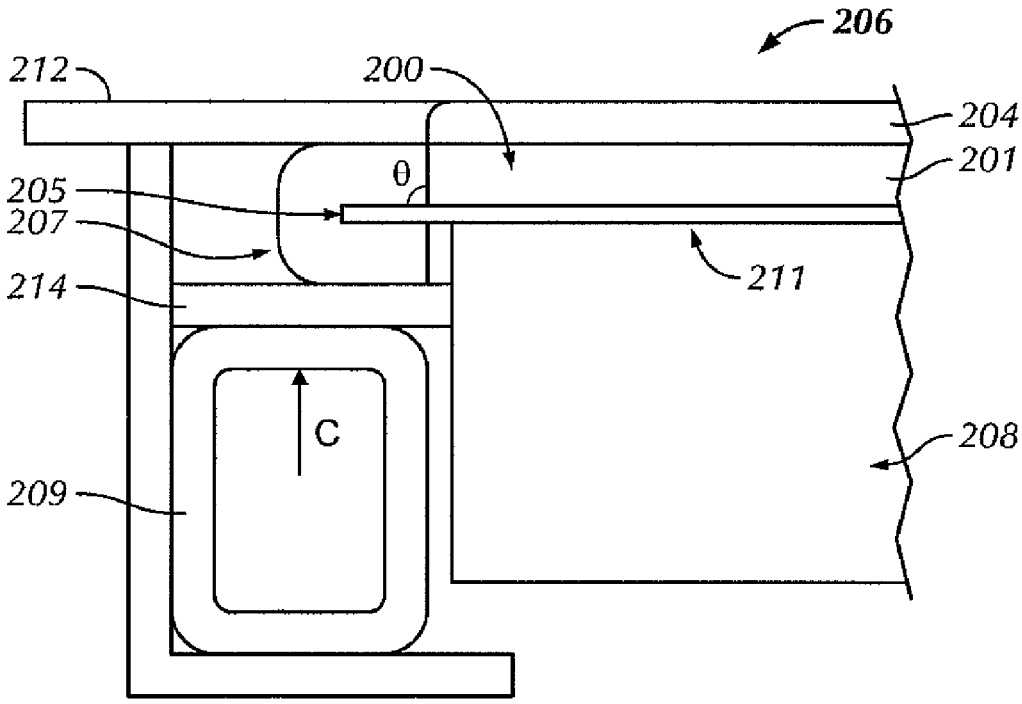
FIG. 2A shows a partial cross-sectional view of a gyratory sifter including a screen according to embodiments of the present disclosure.

Referring to FIG. 2A, a cross-sectional view of a gyratory sifter 206 including a screen 200 according to embodiments of the present disclosure is shown. In this embodiment, gyratory sifter 206 includes screen 200, screen gasket 207, ball box 208, a screen locating device 209, and a screen plate 212. Screen 200 includes structural elements (as described above relative to screen 100), including, for example, filtering element 204, rigid external extension 205, and frame 201. Features described in FIG. 1 may be incorporated as features in FIG. 2.

As illustrated, screen 200 is disposed within gyratory sifter 206. A screen gasket 207 is disposed on rigid external extension 205. Screen gasket 207 may be formed from, for example, rubber, polyurethane, or other materials known to those of ordinary skill in the art. Furthermore, screen gasket 207 may be disposed on a select side or all sides of frame 201, according to the requirements of a specific sifter. Those of ordinary skill in the art will appreciate that seal gasket 207 may provide a more effective seal if seal gasket 207 surrounds the entire periphery of screen 200.

Frame 201 also includes rigid external extension 205 extruding from the periphery of screen 200. The interface area between frame 201 and rigid external extension 205 defines an included angle Θ. Included angle Θ is defined by the intersection of frame 201 and the protrusion of rigid external extension 205. As illustrated, included angle Θ is substantially 90°, however, those of ordinary skill in the art will appreciate that included angle Θ could include angles of less than or greater than 90°. In certain embodiments, included angle Θ may be obtuse prior to installation of filtering element 204 onto frame 201. The installation of filtering element 204 may then decrease included angle Θ to, for example, to a 90° or otherwise acute angle. In other embodiments, the rigidity of frame 201 and rigid external extension 205 may be such that the tensioning of filtering element 204 may not cause included angle Θ to change.

Generally, rigid external extension 205 may be manufactured to form a substantially continuous curve having included angle Θ at its apex. Those of ordinary skill in the art will appreciate that such a substantially continuous curve may be inclusive of a substantially 90° included angle because the manufacturing of frame 201 may provide for the curvature. Such curvature may further provide for increased frame 201 rigidity, thereby increasing the resistance of frame 201 to bending.

Screen 200 is disposed in gyratory sifter 206 on top of ball box 208. Ball box 208 includes a rigid structure having contours that match a bottom surface 211 of screen 200. As such, as screen 200 is disposed on top of ball box 208, screen 200 may be secured in place. Examples of methods to secure screen 200 to ball box 208 may include mechanical fasteners, such as clasps, latches, or screws. However, those of ordinary skill in the art will appreciate that in certain embodiments, additional fasteners may not be necessary, as the weight and/or design dynamics of screen 200 may provide effective securing.

Figure 2B:
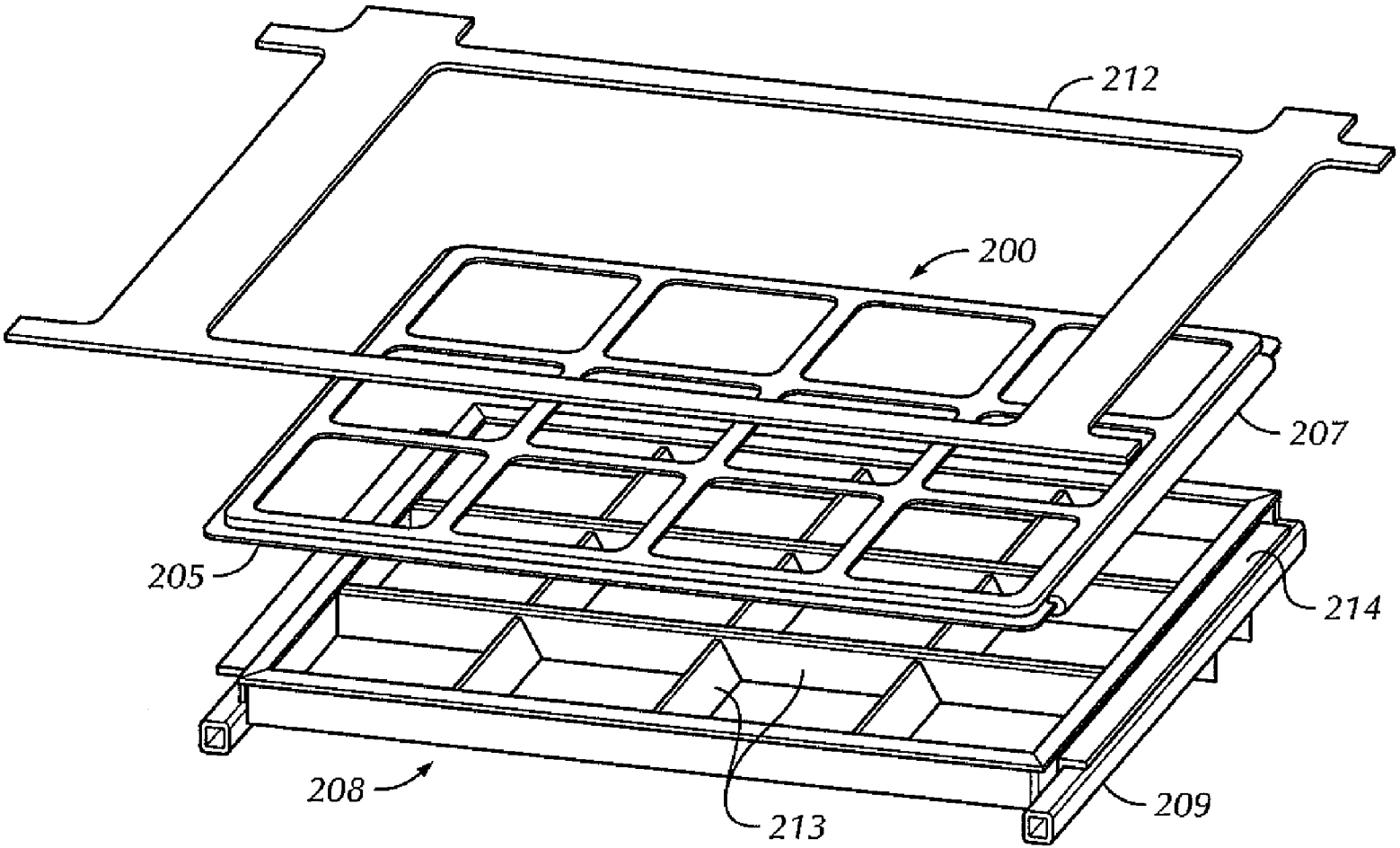
FIG. 2B shows a break-away view of a gyratory sifter including a screen according to embodiments of the present disclosure.

In one embodiment, ball box 208 may be manufactured from steels, such as 300 series stainless steel, carbon steel, plastics, or composites, such as those discussed with respect to frame 201 above. Referring briefly to FIG. 2B, a breakaway perspective view of screen 200 relative to ball box 208, and a screen plate 212 is shown. In this embodiment, screen 200 has a screen gasket 207 on one side, however those or ordinary skill in the art will appreciate that in some embodiments, screen gasket 207 may extend around the complete periphery of screen 200. Those of ordinary skill in the art will appreciate that in certain embodiments ball box 208 may be a contoured surface area on which a screen 200 may be disposed. However, in some embodiments, ball box 208 may be configured to include a plurality of balls or discs that may move against screen 200 during operation to further assist sifting.

Ball box 208 includes a plurality of box support members 213 that provide structural integrity, as well as a contoured surface to provide a resting surface for screen 200. In this embodiment, ball box 208 also includes a mating surface 214, on which screen 200 may rest when installed. As illustrated, mating surface 214 may be a recessed portion of ball box 208 that provides a support surface for rigid external extension 205. Such a mating surface 214 may thereby provide a male/female installation configuration, so that the lateral movement of screen 200 may be restricted.

In this embodiment, plate screen 212 is shown disposed above screen 200. During installation, plate screen 212 may be lowered into contact with screen 200 to limit vertical movement of screen 200. Plate screen 212 may be locked into place via a mechanical fastener, as described above, or may otherwise be held in place by other components of the gyratory sifter. Plate screen 212 may be manufactured and/or formed from, for example, steel alloys, such as 300 series stainless steel, composites, carbon steels, or other materials known to those of skill in the art.

Referring to FIGS. 2A and 2B together, mating surface 214 is shown disposed over a screen locating device 209. Screen locating device 209 may include airbags, such as those used in pneumatic screen changes, mechanical actuators, or other methods of locating, securing, and otherwise changing screens on gyratory sifters. In this embodiment, screen locating device 209 is movable in direction C to provide a force against screen gasket 207. As illustrated, screen 200 is disposed between screen plate 212 and ball box 208, such that a seal is formed by screen gasket 207 between mating surface 214 and screen plate 212. In certain embodiments, screen locating device 209 may include slidable rails that provide a force in direction C to further increase the sealing ability of seal gasket 207. Moreover, in some embodiments, screen locating device 209 may be used to automate or otherwise facilitate screen changes.

Figure 3A:
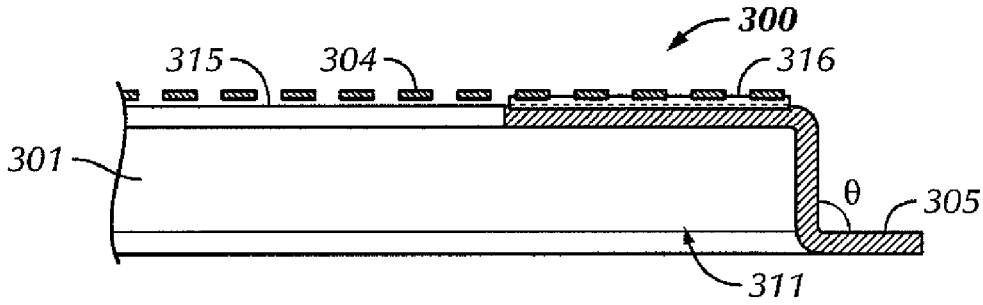
FIGS. 3A-3C show cross-sectional views of a screen according to embodiments of the present disclosure.
Figure 3B:
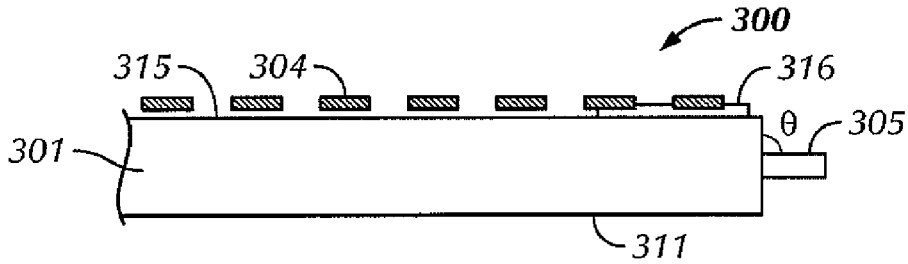
Figure 3C:
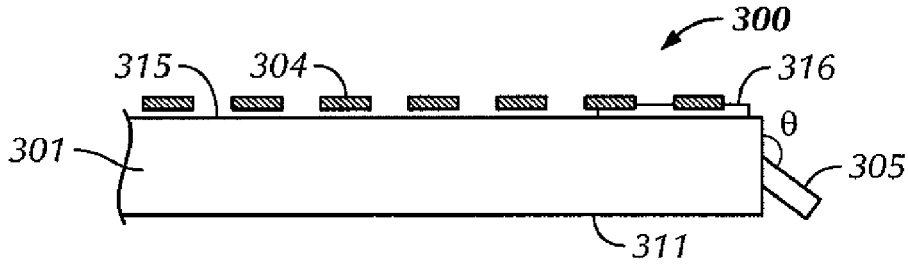

Referring to FIG. 3A, a cross-section of a screen 300 according to embodiments of the present disclosure is shown. In this embodiment, screen 300 includes a frame 301 having a top surface 315 and a bottom surface 311. Screen 300 also includes a rigid external extension 305 forming an included angle Θ, as described above. In this embodiment rigid external extension 305 is a protrusion of frame 301 that is flush with and forms an integral part of bottom surface 311. However, in alternate embodiments, rigid external extension 305 may form varied geometries. Referring briefly to FIG. 3B, rigid external extension 305 may be disposed in the center of frame 301. In this embodiment, included angle Θ is still substantially 90°, however, rigid external extension 305 does not from a part of bottom surface 311. Referring briefly to FIG. 3C, in still another embodiment, external extension 305 may be substantially angled, as described above, such that included angle Θ is obtuse. Those of ordinary skill in the art will appreciate that the specific geometry of rigid external extension 305 is not a limitation on the scope of the present disclosure. Rigid external extension 305 may thus be any geometry that prevents reduces a bending of frame 301 due to pre-tensioning, as described above.

Referring to FIGS. 3A-3C together, filtering element 304 may be secured to frame 301 by any method known to those of skill in the art. Exemplary methods may include gluing, heat staking, thermal bonding, welding, epoxies, or via mechanical fasteners, all generally represented at 316. Thus, pre-tensioning methods 316 may be used to secure filtering element 304 to frame 301 such that a desired tension may be achieved. Those of ordinary skill in the art will appreciate that the precise tension of filtering element 304 will vary depending on the requirements of the screen 300 or the sifting operation.

Figure 4A:
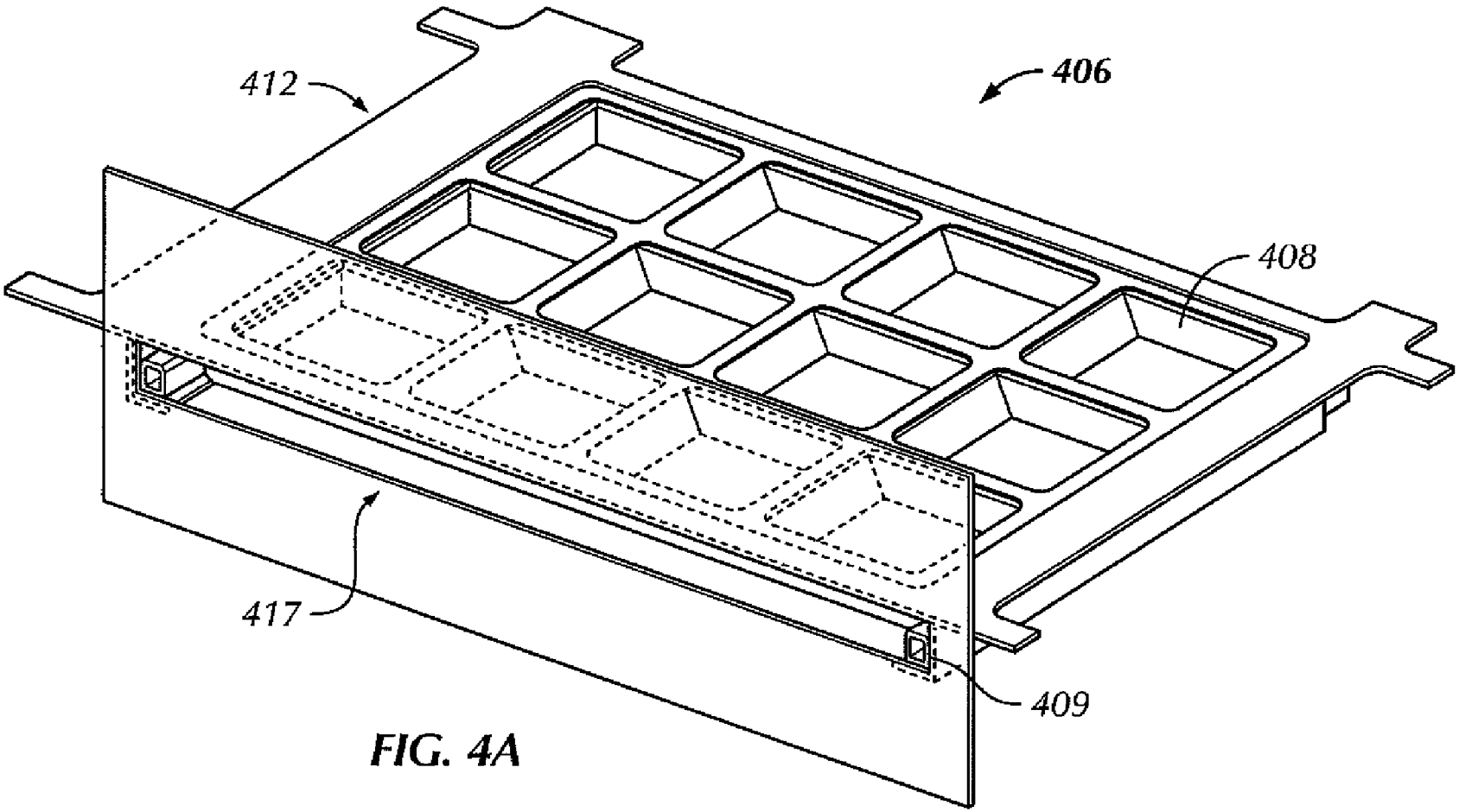
FIGS. 4A and 4B show a method of installing a screen in a gyratory sifter according to methods of the present disclosure.
Figure 4B:
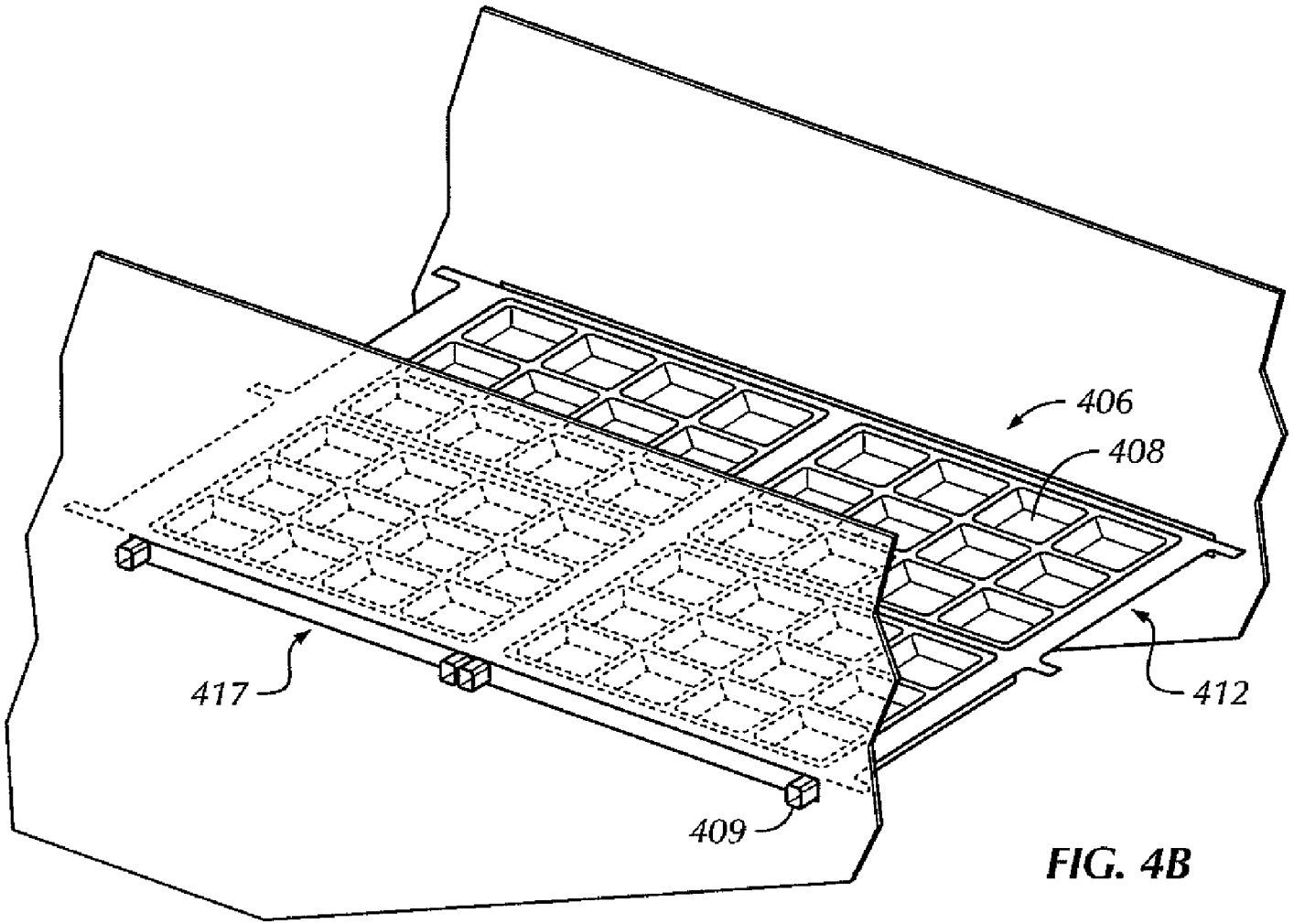

Referring to FIGS. 4A and 4B together, a method of installing and/or changing a screen 400 according to embodiments of the present disclosure is shown. In this embodiment, a gyratory sifter 406 is illustrated including a plate deck 412, a ball box 408, and a screen locating device 409. During screen removal and installation, screen locating device 409 may be actuated to lower ball box 408. A screen may then be detached from ball box 408 and removed through a door opening 417 in gyratory sifter 406. A new pre-tensioned screen may then inserted through door opening 406 and mated to ball box 408, as described above. Screen locating device 409 may then be actuated to secure the pre-tensioned screen with the plate deck 412.

In other embodiments wherein gyratory sifter 406 does not include door opening 417, plate deck 412 may be manually removed by, for example, lifting plate deck 412 off of a screen (not shown). The screen may then be unmated from ball box 408 by, for example, unfastening mechanical fasteners, and removed from gyratory separator 406. A new pre-tensioned screen may then be inserted onto ball box 408 and mated therewith. After mating the new pre-tensioned screen with the ball box 408, the pre-tensioned screen may be secured in place by lowering plate deck 412. Those of ordinary skill in the art will appreciate that a number of methods of removing, changing, and installing pre-tensioned screens in gyratory sifters fall within the scope of the present disclosure. In certain embodiments, the steps of mating and securing the new pre-tensioned screen in the gyratory sifter may include actuating seal locating devices, inserting male/female connectors and fastening mechanical devices. However, in other embodiments, mating and securing may otherwise include placing the pre-tensioned screen against or within a support structure.

Embodiments of the present disclosure, as described above may be manufactured according to various methods. For brevity, only one such method is described in detail below. In one embodiment, a screen, including a frame may be formed from, for example, a steel by pressing the steel into a desired geometry. The geometry will generally include a plurality of cross-members and a rigid external extension. In this embodiment, the rigid external extension may form a substantially continuous curve having an included angle of substantially 90°.

Once the frame is formed, a filtering element may be secured to the frame by applying a powder epoxy to the surface of the frame and mounting the filtering element thereto. The filtering element may be held in place at a desired tension until the filtering element is sufficiently secured to the frame. After the filtering element is secured to the frame, a screen gasket may be installed along the rigid external extension. Installing the screen gasket may include gluing or placing the screen gasket around the rigid external extension.

Those of ordinary skill in the art will appreciate that the above description of manufacturing screens according to embodiments disclosed herein is merely illustrative. Methods of such manufacturing steps may vary according to the materials being used, and as such, the example described is not meant as a limitation on the scope of the present disclosure. For example, in certain embodiments, forming a frame may include bending a metal, mixing a resin to form a composite, or welding frame components together. Additionally, securing a filtering element may include any method of attaching a filtering element to a frame known to those of ordinary skill in the art.

Advantageously, embodiments of the present disclosure may provide pre-tensioned screens that may be less likely to suffer structural integrity failure during use. Because the screens disclosed herein have a geometry that may prevent the frame from bowing due to pre-tensioning, the frames may have a longer operational lifespan. Moreover, because the screens may be less likely to bend, the filtering elements may remain more taut, thereby assisting in efficiency of sifting operations.

Also advantageously, pre-tensioned screens according to embodiments disclosed herein may ease the installation process associated with screen changes in sifting operations. For example, because the screens are pre-tensioned, the installation operations may take less time, require less labor, or become sufficiently automated to streamline the process. Furthermore, because rigid external extensions may have seal gaskets disposed thereon, a tighter seal may be realized between the frame and the gyratory sifter. A tighter seal may further increase the lifespan of screens disclosed herein, because the vibrations of the screen within the gyratory sifter may be restricted. Restricting vibrations of the screen against, for example, the plate screen, may reduce the wear on the filtering element that may otherwise become loose and experience reduced tautness over time. As such, the lifespan on the screen, along with the efficiency with which associated screens may operate, may thereby be further increased.

While the present disclosure has been described with respect to a limited number of embodiments, those skilled in the art, having benefit of the present disclosure will appreciate that other embodiments may be devised which do not depart from the scope of the disclosure described herein. Accordingly, the scope of the disclosure should be limited only by the claims appended hereto.

What is claimed is:

1. A method for installing a pre-tensioned screen in a gyratory sifter comprising:

inserting the pre-tensioned screen into the gyratory sifter, the pre-tensioned screen comprising:

a frame having a plurality of cross-members and a rigid external extension that extends from the periphery of the frame on at least three sides; and a filtering element secureably attached to the frame;

mating the pre-tensioned screen to a ball box; wherein the mating comprises placing the pre-tensioned screen against a contoured section of the ball box; and securing the pre-tensioned screen with a screen plate.

2. The method of claim 1, wherein the securing comprises contacting a top portion of the pre-tensioned screen with a bottom portion of a screen plate.

3. The method of claim 1, further comprising:

locating the pre-tensioned screen against the ball box through a hole in the screen plate.

4. The method of claim 3, wherein the locating comprises: actuating a seal locating device.

5. The method of claim 4, wherein the actuating device is one selected from a group consisting of mechanical actuators and pneumatic actuators.

* * * * *